US006740141B2

(12) United States Patent
Espin et al.

(10) Patent No.: US 6,740,141 B2
(45) Date of Patent: May 25, 2004

(54) METHOD FOR REMOVING $H_2S$ AND $CO_2$ FROM ABOVE GROUND HYDROCARBON STREAMS

(75) Inventors: Douglas Espin, Caracas (VE); Aaron Ranson, San Antonio de Los Altos (VE); Mariela Araujo, San Antonio de Los Altos (VE); Kenneth Klabunde, Manhattan, KS (US); Shawn Decker, Manhattan, KS (US); Slawomir Winecki, Manhattan, KS (US)

(73) Assignees: Intevep, S.A., Caracas (VE); NanoScale Materials, Inc., Manhattan, KS (US)

( * ) Notice: Subject to any disclaimer, the term of this patent is extended or adjusted under 35 U.S.C. 154(b) by 0 days.

(21) Appl. No.: 10/228,123

(22) Filed: Aug. 26, 2002

(65) Prior Publication Data

US 2003/0033934 A1 Feb. 20, 2003

Related U.S. Application Data

(63) Continuation of application No. 09/791,178, filed on Feb. 23, 2001, now Pat. No. 6,447,577.

(51) Int. Cl.[7] ..... B01D 53/04

(52) U.S. Cl. ..... 95/136; 95/139; 585/820; 166/267

(58) Field of Search ..... 95/90, 135, 136, 95/139; 210/667, 747; 502/325, 328, 340; 166/265, 266, 267, 276, 279; 585/820

(56) References Cited

U.S. PATENT DOCUMENTS

| | | | | |
|---|---|---|---|---|
| 2,618,588 A | | 11/1952 | Hendel | |
| 4,121,663 A | | 10/1978 | Compton | |
| 4,877,647 A | | 10/1989 | Klabunde | |
| 4,988,653 A | | 1/1991 | Herbst et al. | |
| 5,310,414 A | | 5/1994 | Najjar et al. | |
| 5,591,418 A | | 1/1997 | Bhattacharyya et al. | |
| 5,626,650 A | | 5/1997 | Rodriguez et al. | |
| 5,759,939 A | | 6/1998 | Klabunde et al. | |
| 6,087,294 A | | 7/2000 | Klabunde et al. | |
| 6,093,236 A | | 7/2000 | Klabunde et al. | |
| 6,280,503 B1 | | 8/2001 | Mayorga et al. | |
| 6,447,577 B1 | * | 9/2002 | Espin et al. | 95/136 |
| 6,513,592 B2 | * | 2/2003 | Espin et al. | 166/295 |
| 6,579,832 B2 | * | 6/2003 | Jimenez et al. | 507/143 |

FOREIGN PATENT DOCUMENTS

| | | |
|---|---|---|
| WO | WO 98/22648 | 5/1998 |
| WO | WO 99/04898 | 2/1999 |

* cited by examiner

*Primary Examiner*—Frank M. Lawrence
(74) *Attorney, Agent, or Firm*—Bachman & LaPointe, P.C.

(57) ABSTRACT

A method for removing at least one contaminant selected from the group consisting of $H_2S$ and $CO_2$ from contaminating streams, including the steps of providing an above ground stream comprising hydrocarbon containing the at least one contaminant, and positioning metal-containing nanoparticles having a particle size of less than or equal to about 100 nm in the stream, the metal-containing nanoparticles being selected from the group consisting of metal oxides, metal hydroxides and combinations thereof, whereby the nanoparticles adsorb the contaminants from the stream.

10 Claims, 1 Drawing Sheet

METHOD FOR REMOVING $H_2S$ AND $CO_2$ FROM ABOVE GROUND HYDROCARBON STREAMS

CROSS-REFERENCE TO RELATED APPLICATION

The instant application is a continuation of U.S. patent application Ser. No. 09/791,178 filed Feb. 23, 2001, now U.S. Pat. No. 6,447,577.

BACKGROUND OF THE INVENTION

The present invention relates to a method for removing $H_2S$ and $CO_2$ from crude and gas streams.

A long standing problem in the oil and gas industry is the presence of $H_2S$ or hydrogen sulfide gas in hydrocarbons. $H_2S$ must frequently be removed before a hydrocarbon can be further processed and/or used as a commercial product.

Another routinely encountered contaminant is $CO_2$, which frequently must be removed as well.

Various surface scrubbing methods and $H_2S$ or $CO_2$ removal devices and methods are known, but the need remains for a simple and efficient method for removal of contaminants in a downhole environment as well as at the surface.

It is therefore the primary object of the present invention to provide a method for removing $H_2S$ and/or $CO_2$ from hydrocarbon gas and crude streams.

It is a further object of the present invention to provide a method for removal of $H_2S$ which is simple and economic in use, and friendly to the environment.

Other objects and advantages of the present invention will appear hereinbelow.

SUMMARY OF THE INVENTION

In accordance with the present invention, the foregoing objects and advantages have been readily attained.

According to the invention, a method is provided for removing at least one contaminant selected from the group consisting of $H_2S$ and $CO_2$ from hydrocarbon streams, which method comprises the steps of providing a stream of hydrocarbon containing said at least one contaminant; and positioning metal-containing nanoparticles in said stream, said metal-containing nanoparticles being selected from the group consisting of metal oxides, metal hydroxides and combinations thereof, whereby said nanoparticles adsorb said at least one contaminant from said stream.

In accordance with a preferred embodiment of the present invention, the hydrocarbon stream to be treated is a downhole stream established from a hydrocarbon producing subterranean formation to a hydrocarbon producing well, and the nanoparticles are positioned in fractures induced into the formation in the form of propants and/or additives to propants, whereby the hydrocarbon stream produced through the fractures is exposed to the nanoparticles and $H_2S$ and/or $CO_2$ are adsorbed downhole.

In accordance with another preferred embodiment of the present invention, the contaminant-adsorptive nanoparticles of the present invention can be utilized at surface locations as well, for example in packing filters and the like, so as to advantageously adsorb $H_2S$ and $CO_2$ contaminants from hydrocarbon streams.

BRIEF DESCRIPTION OF THE DRAWINGS

A detailed description of preferred embodiments of the present invention follows, with reference to the attached drawings, wherein.

DETAILED DESCRIPTION

Figure 1:
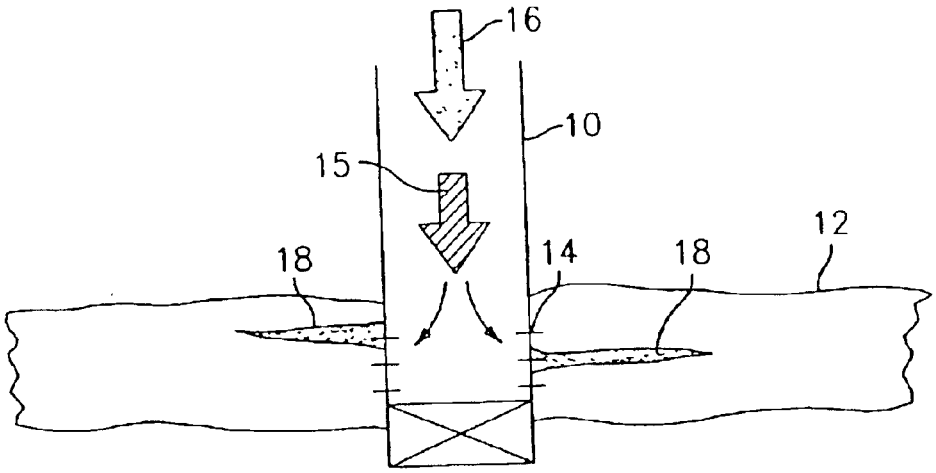
FIG. 1 illustrates a preferred embodiment of the present invention wherein a fracturing fluid is injected into a well to form fractures and nanoparticles are disposed therein.

The present invention relates to a method for removing $H_2S$ and $CO_2$ from hydrocarbon streams, and advantageously provides for positioning of $H_2S$ adsorptive metal-containing oxide nanoparticles within the stream at desirable locations whereby $H_2S$ and/or $CO_2$ are absorbed so as to produce a hydrocarbon stream having reduced $H_2S$ content.

In accordance with the present invention, it has been found that reactive nanoparticles having high surface area provide for excellent adsorption of $H_2S$ and $CO_2$ from crude and gas hydrocarbon streams, and the adsorption capacity of such particles is not substantially adversely affected by increased temperatures. This is particularly surprising in that many conventional systems for removal of $H_2S$ are rendered less effective in the presence of $CO_2$, wherein the nanoparticles of the present invention have been found to be effective at removal of both $H_2S$ and $CO_2$. This finding advantageously allows for such metal oxide nanoparticles to be disposed in downhole locations whereby $H_2S$ and $CO_2$ removal can be accomplished in the well as the hydrocarbon stream is being produced.

In accordance with a particularly preferred embodiment of the present invention, the reactive metal-containing nanoparticles are preferably selected from the group consisting of metal oxides and metal hydroxides, and mixtures thereof. These nanoparticles are useful at both surface and downhole locations, and downhole applications are particularly advantageous environments of use. For use in a downhole location, a fracturing fluid can be introduced into a well so as to form fractures in the hydrocarbon-producing formation, and the nanoparticles are then disposed in such fractures, either as propants and/or as an additive or coating to a propant, whereby hydrocarbon streams produced through the fracture are exposed to the nanoparticles as desired.

In accordance with the present invention, suitable nanoparticles preferably have a particle size of less than or equal to about 100 nm, preferably less than or equal to about 30 nm, more preferably between about 1 nm and about 20 nm and most preferably between about 1 nm and about 10 nm. These nanoparticles can be produced utilizing any known techniques. Examples of disclosures related to preparation of suitable nanoparticles are presented in U.S. Pat. Nos. 5,759,939, 4,877,647 and 6,087,294.

It is preferred that the nanoparticles of the present invention have a surface area greater than or equal to about 80 $m^2/g$, which has been found to provide excellent adsorption capacity as will be demonstrated in the examples which follow.

Suitable materials from which nanoparticles can be provided in accordance with the present invention include metal oxides and/or metal hydroxides, and the metal is preferably a metal selected from the group consisting of calcium, magnesium, zinc, iron and other metals from groups 8, 9 or 10 or the periodic table of elements (CAS Group VIII). For adsorption of $H_2S$, the most preferred material is calcium oxide (CaO), and for adsorption of $CO_2$, the most preferred material is calcium oxide coated with iron oxide ([$Fe_2O_3$]CaO). For environments where both $H_2S$ and $CO_2$ are to be removed and $CO_2$ is present in amounts of greater than 50% by vol., the most preferable nanoparticles have been found to be calcium oxide coated with iron oxide ([$Fe_2O_3$]CaO).

It is particularly preferred that nanoparticles in accordance with the present invention have a chemical structure containing less than or equal to about 100 atoms. This advantageously provides for increased surface area and adsorption of $H_2S$ and $CO_2$ even in the presence of other gases, all as desired in accordance with the present invention.

As set forth above, nanoparticles in accordance with the present invention are positioned in an $H_2S$ and/or $CO_2$-containing hydrocarbon stream, and the nanoparticles serve to adsorb the $H_2S/CO_2$ from the hydrocarbon stream so as to provide a hydrocarbon product having reduced $H_2S$ content.

The nanoparticles in accordance with the present invention can be positioned within a stream of hydrocarbon to be treated in a number of different ways. It is within the broad scope of the present invention to position the nanoparticles in various packed filters, which can be made from nanoparticle pellets or powder packing, and such filters can be positioned at the surface of a well and/or downhole through a production tubing, or in any other desired location. In accordance with a particularly preferred embodiment of the present invention, in wells which are to be fractured for enhancing production, nanoparticles are disposed in the fractures for contacting fluid as it flows into the well.

In the downhole fracture environment, nanoparticles may suitably be disposed within the fractures by fracturing the formation with a fracturing fluid and following the fracturing fluid with a fluid carrying the nanoparticles. Flowing of this fluid through the formed fractures disposes the nanoparticles therein and serves to stabilize such fractures as desired, and further position the desired high surface area metal-containing nanoparticles within the hydrocarbon stream to be produced through such fractures, all as desired in accordance with the present invention.

Referring to FIG. 1, this preferred embodiment is schematically illustrated. FIG. 1 shows a well 10 positioned to a subterranean hydrocarbon producing formation 12 and having perforations 14 through which hydrocarbons are produced. A fracturing fluid 15 is injected into well 10 and reaches formation 12 through perforations 14 at pressure and flow rate sufficient to form fractures 18 within formation 12. Fluid 16 carrying nanoparticles in accordance with the present invention is then pumped into well 10, and the nanoparticles are positioned within fractures 18 as schematically illustrated in FIG. 1 and as desired in accordance with the present invention.

It is conventional in fracturing processes to include various propant particles in the fracturing fluid, or in a wash after the fracturing fluid, so that such propant particles are positioned within the fractures to hold such fractures open and enhance flow through same. In accordance with the present invention, the reactive metal oxide nanoparticles may themselves be used as propant particles, or such nanoparticles can be disposed as a coating or other ingredient or additive to the propants, so as to provide the desired positioning within fractures 18.

In accordance with the present invention, the metal-containing nanoparticles may be utilized in various forms. The most preferred form is to agglomerate these nanoparticles into pellets of suitable size and dispose such pellets into the hydrocarbon stream. Alternatively, if desired, the nanoparticles may be disposed onto other substrate particles and the like, if desired.

It should be noted that FIG. 1 illustrates a well 10 having perforations 14. The method and nanoparticles of the present invention would also be applicable for open hole wells and any other environment for downhole or surface application.

Figure 2:
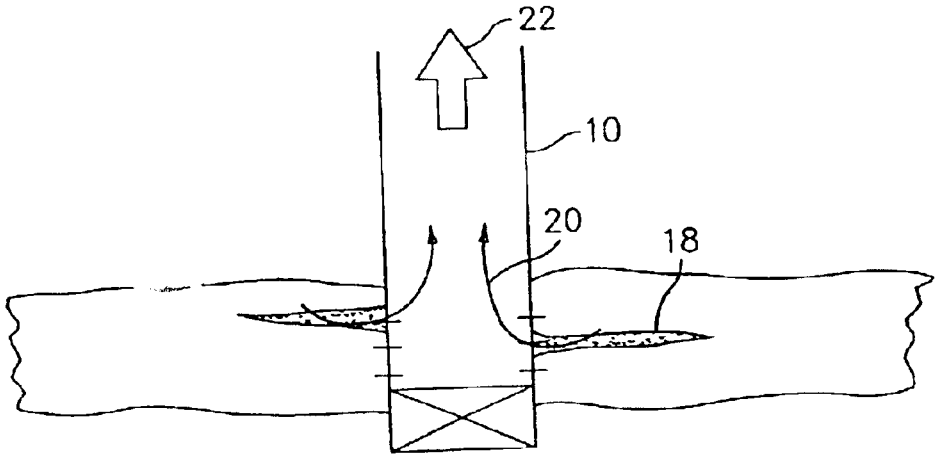
FIG. 2 further illustrates the embodiment of FIG. 1, wherein particles within fractures are positioned in a stream of hydrocarbon flowing from a formation into a production well.

FIG. 2 shows the well 10 of FIG. 1 after the fracturing step has been carried out and schematically shows hydrocarbon 20 being produced from fractures 18 into well 10 and flowing past particles within fracture 18, such that product 22 has reduced $H_2S$ and $CO_2$ content.

In accordance with the present invention, it has been found that suitable metal-containing nanoparticles have substantially larger adsorption capacity than any conventional product, and that this $H_2S$ adsorption capacity is not adversely affected by the presence of other gases such as $CO_2$, or by increased temperature, and $CO_2$ can in fact be removed as well. As set forth above, the resistance to increased temperature makes the nanoparticles of the present invention particularly well suited to downhole application as illustrated in FIGS. 1 and 2.

Depending upon the flow to which nanoparticles in accordance with the present invention are exposed, nanoparticles will have a useful lifetime of approximately two years. Of course, nanoparticles can readily be replaced in the form of different filter packs, and/or during other service operations on the well.

Figure 3:
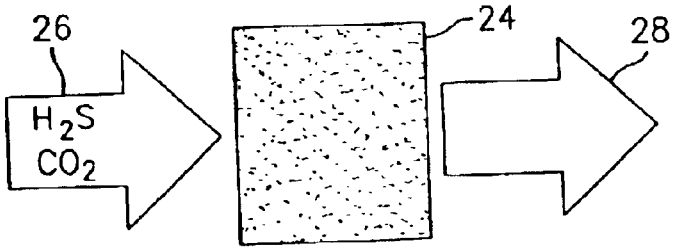
FIG. 3 illustrates an alternative embodiment of the present invention wherein a hydrocarbon stream is treated using a schematically illustrated filter pack, for example at a surface location.

Turning to FIG. 3, an alternative application of nanoparticles in accordance with the present invention is illustrated. As schematically shown, nanoparticles can be disposed within a filter pack 24 and positioned along a flow of hydrocarbon to be treated. FIG. 3 schematically shows a stream 26 containing $H_2S$ and $CO_2$ being fed to filter pack 24, and a product stream 28 having reduced $H_2S$ and $CO_2$ content as desired in accordance with the present invention. Such a filter pack 24 can advantageously be positioned at any desired location along a hydrocarbon stream carrying hydrocarbons to be treated.

It is noted that the embodiments of FIGS. 1–3 all advantageously serve to provide excellent reduction in $H_2S$ and $CO_2$ content in the hydrocarbon stream, and show enhanced removal-capacity as compared to commercial products. Further, the particular characteristics of nanoparticles in accordance with the present invention allow for the downhole application of such nanoparticles, and thereby the downhole removal of $H_2S$ and $CO_2$, which provides a significant benefit in the industry.

It has also been found that the process by-products are environmentally friendly metal sulfates which can be used in other applications and industries, for example as a fertilizer for agriculture and soil enrichment, and in the fabrication of cement for construction applications. Thus, the metal oxide nanoparticles and method for using same in accordance with the present invention also provide an environmentally friendly method for disposition of the $H_2S$ and $CO_2$.

EXAMPLE 1

A number of different metal oxide compounds were evaluated to identify the typical surface area thereof, and this information is set forth in Table 1 below.

TABLE 1

| Compound | Typical Surface Area ($m^2/g$) | Compound | Typical Surface Area ($m^2/g$) |
|---|---|---|---|
| AP-MgO | 400 | AP-CaO | 130 |
| CP-MgO | 200 | CP-CaO | 100 |
| CM-MgO | 10–30 | CM-CaO | 1–3 |

The compounds evaluated were three different types of magnesium oxide and three different types of calcium oxide. The three types of magnesium oxide were AP-MgO, CP-MgO, and CM-MgO. AP-MgO is magnesium oxide prepared according to an aerogel process, which is a non-evaporative process for forming nanoparticles. The CP-MgO is magnesium oxide formed according to conventional nanoparticles-forming processes, and the CM-MgO is commercially available magnesium oxide. The AP, CP and CM denominations have the same meaning for the calcium oxide particles as well.

The compositions of Table 1, as well as iron oxide-coated calcium oxide $Fe_2O_3$(CaO)-AP were evaluated at 40° C. and at 120° C. for adsorption capacity in terms of adsorption capacity (pounds of gas removed per pound of product), as were one commercial $H_2S$ product bearing the trademark SULFATREAT™, from Sulfatreat Company.

Table 2 below sets forth the results in terms of adsorption capacity (lb/lb) for each oxide.

TABLE 2

| Ads | Temp | Gas | Ads. Cap. (lb. gas rem/lb. product) |
|---|---|---|---|
| CaO-CP | 40° C. | $H_2S$ | 0.628 |
| CaO-CP | 120° C. | $H_2S$ | 0.54 |
| $Fe_2O_3$ (CaO) (AP) | 40° C. | $H_2S$ | 0.43 |
| $Fe_2O_3$ (CaO) (AP) | 120° C. | $H_2S$ | 0.37 |
| MgO-AP | 40° C. | $H_2S$ | 0.19 |
| Sulfatreat | 40° C. | $H_2S$ | 0.12 |
| CaO-CP | 40° C. | $CO_2$ | 0.41 |
| [$Fe_2O_3$] CaO | 40° C. | $CO_2$ | 0.56 |
| Ca $(OH)_2$ | 40° C. | $H_2S$ | 0.48 |
| ZnO | 40° C. | $H_2S$ | 0.38 |
| ZnO | 120° C. | $H_2S$ | 0.43 |

It should be readily appreciated that a method has been provided in accordance with the present invention which advantageously meets the objective set forth herein, and which is particularly useful in removal of $H_2S$ from hydrocarbon streams at surface or downhole locations.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A method for removing at least one contaminant selected from the group consisting of $H_2S$ and $CO_2$ from above ground hydrocarbon streams, comprising the steps of:

providing an above ground stream of hydrocarbon containing said at least one contaminant; and positioning metal-containing nanoparticles having a particle size of less than or equal to about 100 nm in said above ground stream, said metal-containing nanoparticles being selected from the group consisting of metal oxides, metal hydroxides and combinations thereof, whereby said nanoparticles adsorb said at least one contaminant from said above ground stream.

2. The method of claim 1, wherein said nanoparticles have a particle size of less than or equal to about 30 nm.

3. The method of claim 1, wherein said nanoparticles have a particle size of between about 1 nm and about 20 nm.

4. The method of claim 1, wherein said nanoparticles have a particle size of between about 1 nm and about 10 nm.

5. The method of claim 1, wherein said nanoparticles have a surface area of at least about 80 $m^2/g$.

6. The method of claim 1, wherein said hydrocarbon stream is selected from the group consisting of hydrocarbon gas, crude and mixtures thereof.

7. The method of claim 1, wherein said nanoparticles contain a metal selected from the group consisting of calcium, magnesium, zinc, iron, and metals from groups 8, 9 and 10 of the period table of elements, and combinations thereof.

8. The method of claim 1, wherein said nanoparticles are calcium oxide having a surface area of greater than or equal to about 80 $m^2/g$.

9. The method of claim 1, wherein said hydrocarbon stream contains $H_2S$ and $CO_2$, and said nanoparticles are iron oxide-coated calcium oxide particles.

10. The method of claim 1, wherein said above ground stream being derived from a below ground source.

* * * * *